US005487720A

United States Patent [19]

Pace

[11] Patent Number: 5,487,720

[45] Date of Patent: Jan. 30, 1996

[54] PARTICLE CONCENTRATOR

[75] Inventor: Dan R. Pace, Halifax, Canada

[73] Assignee: Occam Marine Technologies Ltd., Nova Scotia, Canada

[21] Appl. No.: 218,464

[22] Filed: Mar. 28, 1994

Related U.S. Application Data

[63] Continuation of Ser. No. 777,321, filed as PCT/CA91/00106, Apr. 3, 1991, abandoned.

[30] Foreign Application Priority Data

Apr. 3, 1990 [CA] Canada ..... 2013694

[51] Int. Cl.[6] ..... B04B 9/00; B04B 1/00

[52] U.S. Cl. ..... 494/35; 494/83; 494/48

[58] Field of Search ..... 494/42, 48, 83, 494/46, 47, 56, 84, 68, 67, 65, 70, 35, 60, 73, 72, 23, 25, 26, 38, 39

[56] References Cited

U.S. PATENT DOCUMENTS

| | | | |
|---|---|---|---|
| 1,294,017 | 2/1919 | Young | 494/46 |
| 1,474,379 | 11/1923 | Robertson | 494/70 |
| 1,585,393 | 5/1926 | Laughlin | 494/67 |
| 1,731,313 | 10/1929 | Miller | 494/47 |
| 1,851,674 | 3/1932 | Krenke | 494/68 |
| 1,968,788 | 7/1934 | Tomlinson . | |
| 2,028,955 | 1/1936 | Shenstone | 494/70 |
| 2,214,831 | 9/1940 | Hall | 494/65 |
| 2,779,536 | 1/1957 | Pomeroy . | |
| 3,255,958 | 6/1966 | Simon | 494/35 |
| 3,311,296 | 3/1967 | Torobin | 494/65 |
| 3,409,521 | 11/1968 | Sharples | 494/73 |
| 3,580,493 | 5/1971 | Jonassen . | |
| 3,640,452 | 2/1972 | Thylefors | 494/41 |
| 3,642,196 | 2/1972 | Nilsson . | |
| 3,648,926 | 3/1972 | Pause . | |
| 3,747,840 | 7/1973 | Weiland | 494/84 |
| 4,044,944 | 8/1977 | Moebus et al. | 494/60 |
| 4,059,223 | 11/1977 | Lewis . | |
| 4,460,352 | 7/1984 | Bruning | 494/70 |
| 4,961,724 | 10/1990 | Pace | 494/68 |

FOREIGN PATENT DOCUMENTS

| | | | |
|---|---|---|---|
| 1435588 | 10/1988 | Australia . | |
| 1435688 | 10/1988 | Australia . | |
| 2255766 | 11/1972 | Germany | 494/48 |
| 2166589 | 1/1975 | Germany | 494/48 |
| 0014024 | of 1909 | United Kingdom | 494/35 |

*Primary Examiner*—David Scherbel
*Assistant Examiner*—Tony G. Soohoo
*Attorney, Agent, or Firm*—Ware, Fressola, Van Der Sluys & Adolphson

[57] ABSTRACT

Upper and lower bowl members are mounted on a common linear cylindrical member and a relief valve provides controlled gas pressure within a centrifuge housing in a low speed decanting centrifuge for separating relatively large particulate material (e.g. yeast) from a feedstock. The centrifuge may be clamped to a container and a pressure differential is created between the centrifuge housing and the container to, in turn, force feedstock upwardly into the lower bowl of the centrifuge. A stack of frustonconical discs carry supernatant downwardly and inwardly for vertical transfer to a discharge chamber, Particulate matter is centrifugally discharged continuously between engageable surfaces of the lower bowl member and the upper bowl member. Hydraulic forces generated within the bowl are isolated from a thrust bearing supporting the bowl and transferring drive forces to an intake. The invention further provides for separately collecting and controlling discharge from the centrifuge housing, whereby gas pressure within the housing may be increased further to partially counterbalance hydrostatic forces within the bowls, thus permitting bowl members of low material strength to be used in relatively high speed separation to improve processing capability.

21 Claims, 10 Drawing Sheets

PARTICLE CONCENTRATOR

This is a continuation of application Ser. No. 07/777,321 filed as PCT/CA91/00106, Apr. 3, 1991, now abandoned.

TECHNICAL FIELD

The present invention relates in general to a compact inexpensive low speed centrifuge primarily useful to microbiologists. In particular it relates to means for maintaining mechanical linkage between the upper and lower bowl assemblies during operation thus permitting employment of optional means disclosed herein for improving processing capacity.

BACKGROUND ART

When attempting to separate particulate matter from a fluid, it is known that very small (slowly settling) particles are exponentially more difficult to separate by centrifugation than larger particles. Accordingly, most disc-type centrifuges are designed to spin at extremely high speeds in order to separate the smallest particles at a reasonable rate. High speeds mean high stress on the equipment and on the particulate matter being separated. On the other hand, it is not always necessary for a centrifuge to be capable of separating extremely small particulate matter, especially if the operator is only interested in larger material.

However, there has not been any consideration given in the past to a disc-type centrifuge dedicated to larger particle separation such that the centrifuge could operate at relatively low speeds, resulting in less stress on the equipment and permitting the utilization of less exotic construction material and techniques.

Commonly assigned Canadian patent application Ser. No. 579,008 filed Sep. 30, 1988, and its corresponding U.S. Pat. No. 4,961,724 issued Oct. 9, 1990, discloses and claims a low speed particle concentrator or centrifuge which overcomes the above-enumerated problems. That device in its preferred embodiment calls for the centrifuge to be mounted on a container whereby the recycle fluids are returned under gravity to the container by way of a circumferential array of channels. The device also calls for the upper bowl to separate completely from the lower bowl during operation thus isolating the lower bowl and associated conduit means from direct linkage to the drive means thereby requiring thrust bearing means accompanying both upper and lower bowl assemblies to receive forces generated axially during operation and permit the lower bowl to rotate solely under the influence of fluid drag. However, there are circumstances where it would be necessary to apply frictional force to the lower bowl assembly such as to limit its freedom of rotation. One such circumstance would be where the associated conduit means must sealingly engage a stationary conduit so as to receive feedstock from a deep or remote container. Another such circumstance would be where the associated conduit means must sealingly engage the centrifuge housing to permit the housing to be pressurized separately from the container to partially counteract hydrostatic forces and allow the centrifuge to be operated at higher than usual speeds.

DISCLOSURE OF INVENTION

The present invention provides certain improvements over the concentrator or centrifuge of the aforementioned Canadian patent application No. 579,008. In particular the present invention provides a mechanism for directly driving the lower bowl member via the transfer tube and a connecting portion thereof which is integral with the transfer tube and the bearing housing of the centrifuge. This allows the unit to operate at higher pressures and also reduces the number of components comprising the concentrator. In addition, a separate, pressure controlled reservoir member may be provided to control the pressures within the housing and to provide a separate outlet for the recycle fluid. The concentrator of this invention may be mounted anywhere, on or separate from the suspension container, as desired.

Generally speaking, therefore, the present invention may be considered as providing a centrifugal particle concentrator for separating particulate matter from a fluid held within a container comprising: a housing, upper and lower rotatable bowl members within the housing, one of the bowl members being vertically movable relative to the other bowl member; rotatable separator means within the bowl members; transfer tube means extending axially of the concentrator, mounting the upper bowl member and the separator means thereon, being drivingly connected to drive means, and having a bore extending longitudinally thereof and communicating the separator means with a discharge chamber of the housing; means for passing fluid from the container to the separator means; and means for removing from the housing particle concentrate rejected from the bowl members.

DESCRIPTION OF THE ESTABLISHED STRUCTURE

Figure 1A:
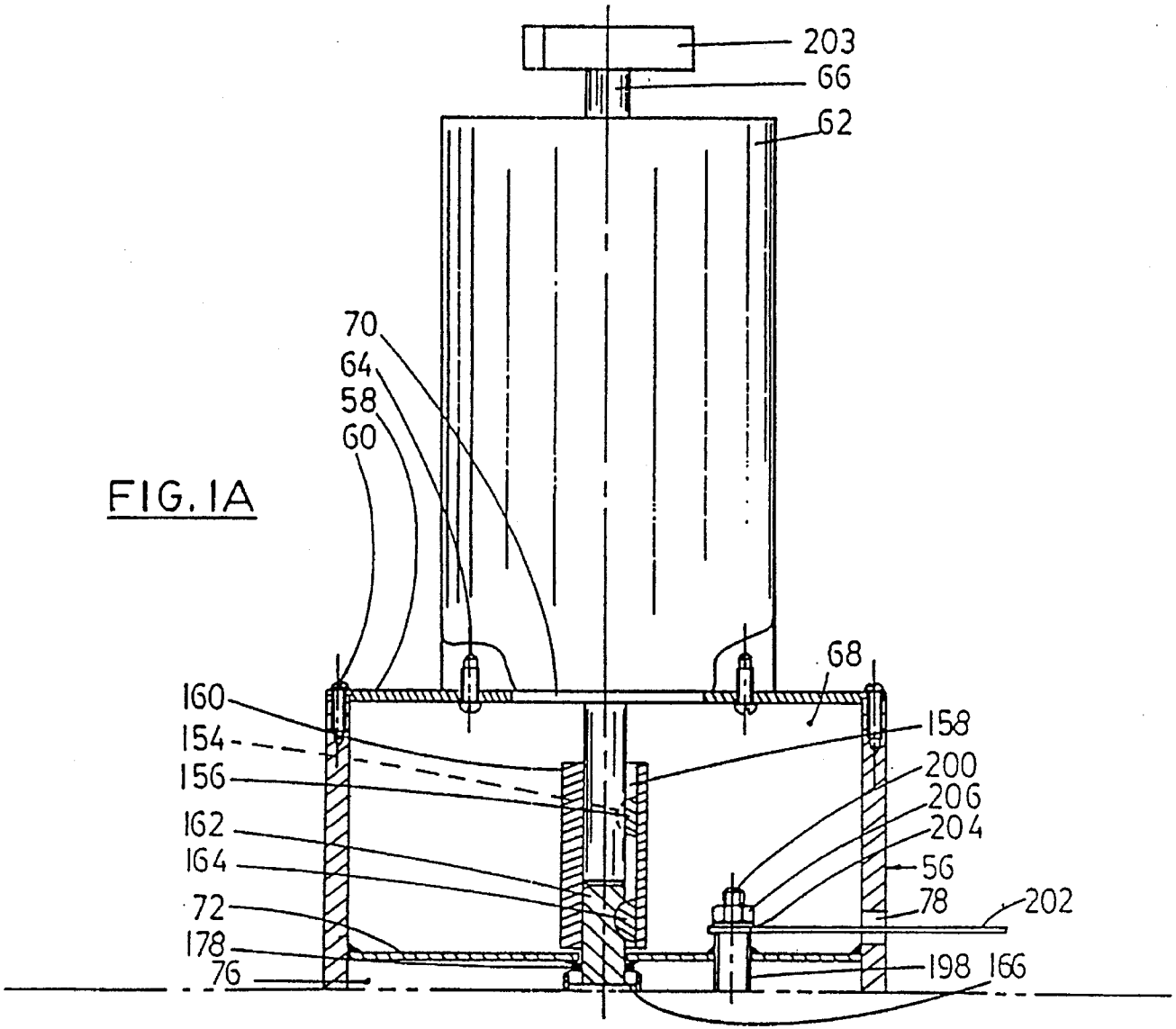
FIGS. 1A, 1B and 1C show a vertical cross-section through the decanting centrifuge according to Canadian Ser. No. 579,008.
Figure 1B:
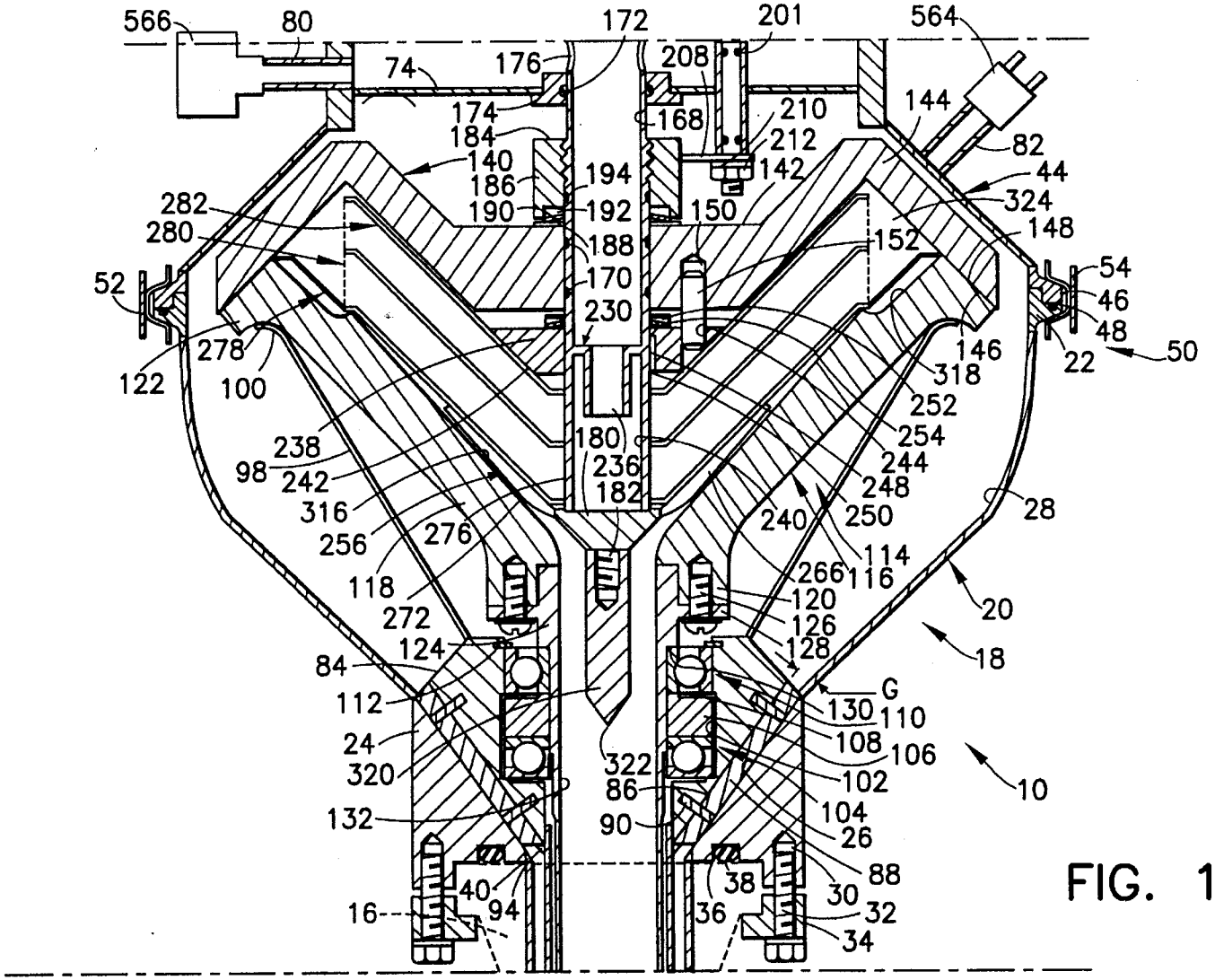
Figure 1C:
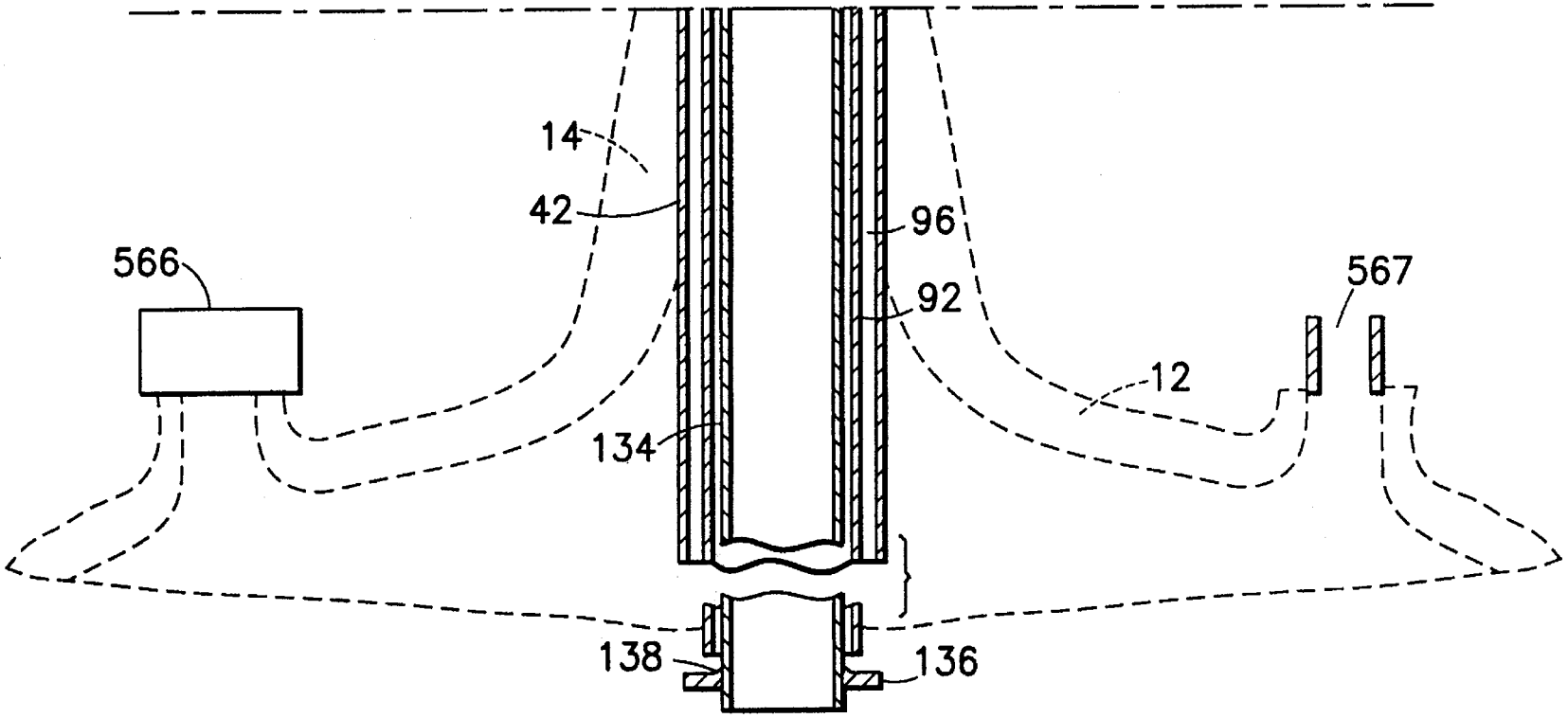

FIG. 1 illustrates in cross-section the major components of the decanting centrifuge according to Canadian Ser. No. 579,008. The centrifuge 10 is particularly designed for, but not restricted to, use with a container 12 having an upwardly-extending cylindrical neck 14 with a peripherally flanged rim 16 at the top thereof.

The centrifuge includes a housing 18 which is composed of a lower upwardly-opening bowl-like member 20 having an upper peripheral rim 22 and an annular lower mounting member 24 for attachment to the container 12. The mounting member is generally triangular in radial cross-section with the inner surface 26 thereof being generally an extension of the inner surface 28 of the lower housing member 20. A plurality of circumferentially spaced threaded bores 30 in the base of the mounting member 24 receive threaded bolts 32 which, in turn hold sections of an L-shaped retaining ring 34 against the underside of container rim 16 so as to clamp the housing to the container. An annular O-ring 36 is held in an annular recess or groove 38 in the base of the mounting member 24 to seal the mounting member to the container.

Welded to the inner circular edge 40 of the mounting member 24 is a downwardly depending outer cylindrical member 42 having an outer diameter approximately equal to the inner diameter of the container neck 14. With the lower housing clamped to the rim 16 the outer cylindrical member 42 will extend into the container. The member 42 could terminate just inside the container or, if deemed desirable, it could extend further into the container perhaps almost to the bottom thereof.

The housing 18 also includes an upper inwardly flaring frustoconical member 44 having a lower circumferential rim 46 which is shaped for an interlocking fit with upper rim 22 of the lower housing member 18. One or both of the rims 22,46 is grooved so as to receive an O-ring 48 and an annular retainer 50 is provided to secure the housing members 18,44 together. Retainer 50 includes an annular, generally V-shaped clamp 52 which is adapted to bear against both rims 22,46 and an outer clamp 54, such as a hose clamp or similar device for applying a peripheral clamping force to the V-clamp 52. Such retaining structure as described herein is commercially available.

The upper circular portion of the member 44 has welded thereto a cylindrical casing 56 which in turn has a motor mounting plate 58 attached to the upper end thereof by way of circumferentially spaced machine screws 60. A D.C. motor 62 is attached to plate 58 via machine screws 64 and the drive shaft 66 thereof extends downwardly into an upper drive chamber 68 through a circular opening 70 in the plate 58.

Drive chamber 68 is defined between mounting plate 58 and a first dividing plate 72 which spans and is welded to the interior of the casing 56. A second dividing plate 74 below the first plate 72 spans and is welded to the interior of casing 56 and defines, with the first plate 72, a discharge chamber 76.

Casing 56 is provided with a horizontal slot 78 above plate 72, spanning a small arc, say about 15°, of the casing side. Also, a discharge outlet port 80 is provided in the casing wall, in communication with the discharge chamber 76. Finally, a gas inlet port 82 is provided in the upwardly sloping wall of the upper frustoconical member 44. The purpose of the slot 78 and the parts 80,82 will become more readily apparent hereinafter.

The foregoing has generally described the exterior aspects of the particle concentrator of Ser. No. 579,008. The interior aspects will now be described.

Within the lower casing or mounting member 24 is an annular lower bearing support member 84 having a frustoconical lower surface 86 parallel to the surface 26 of the mounting member 24. Attached to the surface 86 is a plurality, at least three, of radially projecting, circumferentially spaced, narrow rectangular vanes 88 secured to the bearing support member 84 by way of pins 90. The vanes 88 rest on the surface 26 and serve to space the bearing support member 84 away from the mounting member 24, defining a gap g therebetween.

An intermediate cylindrical member 92 is welded to the bearing support member 84 as at 94 and extends downwardly within the outer cylindrical member 42 so as to define an annular space 96 therebetween. Like member 42, the cylindrical member 92 can descend a short distance so that it just enters the container or it can extend downwardly a greater distance, perhaps almost to the bottom of the container. Preferably the member 92 will enter the container at least as far as the member 42.

A metallic, frustoconical thin deflector member 98 flares upwardly and outwardly from the top of the bearing support 84 and has an outwardly extending peripheral lip 100 at the top edge thereof. The function of the deflector member 98 will be discussed in greater detail hereinafter.

The bearing support 84 includes a counterbore 102 which receives a lower thrust ball bearing assembly 104, an annular bearing spacer 106, an upper radial ball bearing assembly 110 and a retaining ring 112, the last-mentioned item engaging in a complementary groove in the wall of bore 102 and serving to hold the bearings and spacer in place. Spacer 106 has a raised inner annular shoulder 108 which engages the inner race of bearing assembly 110 and thus takes the load off the outer race of that bearing assembly. There is a slight clearance between the outer surface of the spacer 106 and the counterbore 102 and the upper and lower races of the thrust bearing 104 are dissimilar in outer and inner diameters to permit gas to flow through the bearing assembly and purge any fluid which might enter the assembly.

Lower bowl assembly 114 includes a frustoconical bowl member 116 having upwardly and outwardly flaring wall 118, a downwardly extending annular hub 120 and an outwardly extending peripheral rim 122. The hub 120 is machined to receive the upper end of a bearing housing 124 which is attached to the hub 120 by machine screws 126 passing through a circumferential flange 128 of the bearing housing 124. The housing 124 has an annular shoulder 130 which rests on the inner race of the upper bearing assembly 110 and a cylindrical bearing portion 132 which engages the inner race of the upper bearing assembly 110 and the upper race of the lower bearing assembly 104 and the spacer 106. The bearing portion 132 extends below the lower bearing assembly 104 and has welded thereto an inner cylindrical member 134 which extends into the container 12 to a level just above the bottom of the container 12. An annular deflector plate 136 may be removably attached to the bottom of the inner member 134, the plate having an upwardly curving fillet portion 138 for increased surface contact with the member 134 and to provide a smooth interface with the outer wall of the inner cylindrical member 134. The plate 136 may extend radially beyond the intermediate member 92 if the intermediate member extends to a level just above the plate 136.

Upper bowl member 140 is positioned above the lower bowl member 116 and has an inner annular portion 142 and an outer portion 144 which has a generally inverted V-shape in cross-section. The portion 144 has an outer annular surface 146 which is sealingly engageable with an upper annular surface 148 of the rim 122 of the lower bowl member 116. As shown in FIG. 1 the outermost annular surface 146 of the lower bowl member 116 and the upper outermost annular surface 148 of the upper bowl member 140 are generally conically shaped. Preferably, the surfaces 146,148 will be generally parallel to the outer, downwardly sloping wall of outer portion 144 although they could also be normal to the central axis A of the centrifuge. A bore 150 extends upwardly into the inner portion 142 of the upper bowl member 140, from the bottom surface thereof, and receives the upper portion of a cylindrical drive pin 152.

As indicated previously, drive shaft 66 extends downwardly from motor 62 into drive chamber 68. Shaft 66 has a keyway 154 which receives a woodruff key 156. That key engages a keyway 158 in a cylindrical drive coupling or motor alignment bushing 160, which bushing receives the shaft 66 therein. A cylindrical transfer shaft 162 has its upper end received in bushing 160, the shaft 162 being keyed to the bushing for rotation therewith by a woodruff key 164 which is bonded to the bushing 160, thereby permitting easy removal of the motor. Shaft 162 extends downwardly through the first dividing plate 72 and terminates at an enlarged annular shoulder defining an end cap 166.

Extending from the shaft 162 is a first cylindrical transfer tube 168 which extends from below the first dividing plate 72 to below the central portion 142 of the upper bowl member 140. Two O-rings 170 seal the tube 168 to the upper bowl member 140 and a gas seal 172 seals the tube with respect to a bushing 174 welded to the second dividing plate 74. In the discharge chamber 76 the transfer tube is provided with a plurality of circumferentially spaced discharge openings 176. At the upper end of the tube 168 the annular cap 166 is welded thereto and a V-ring seal 178 is positioned between the cap 166 and the underside of the first dividing plate 72, seal 178 also surrounding the transfer shaft 162. At its lower end (opposite transfer shaft 162) the tube 168 is welded to a generally frustoconical head member 180 which, in turn has a threaded shank 182 projecting axially therefrom.

In the area between the dividing plate 74 and the upper bowl member 140 the tube 168 is externally threaded as at 184 and an internally threaded adjusting nut 186 is engaged therewith. A washer 188 rests on the upper bowl member 140 and a wave spring 190 is positioned between the washer 188 and a counterbore 192 in the bottom of the nut 186. Spring 190 applies a downwards bias on the upper bowl member 140 against the adjusting nut 186. An O-ring 194 seals the transfer tube 168 to the axial bore of the adjusting nut.

Figure 2:
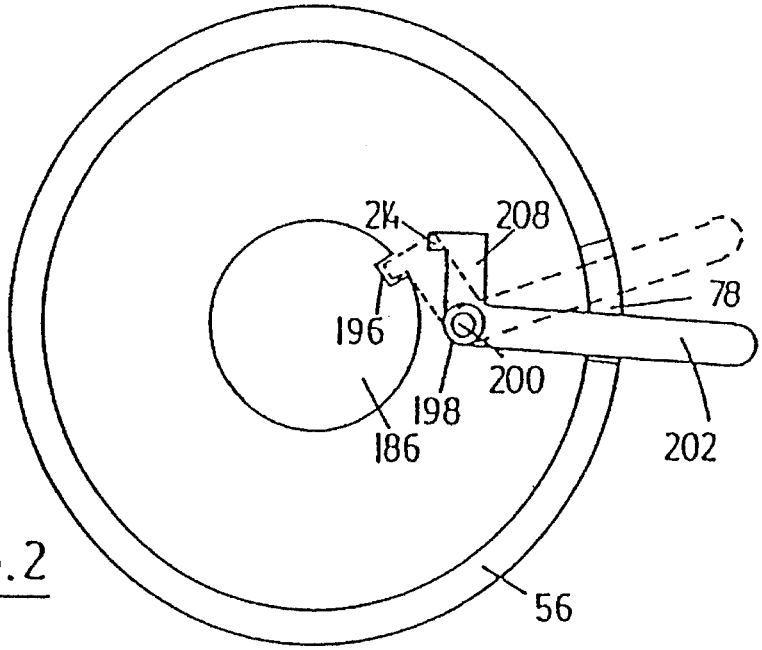
FIG. 2 illustrates in plan the operation of the adjusting nut used in the invention of Ser. No. 579,008.

As seen in FIG. 2, the adjusting nut 186 has a rectangular recess 196 in the upper side wall thereof.

Extending downwardly through the upper and lower dividing walls 72,74 and welded thereto is a second transfer tube 198. A transfer shaft 200, threaded at each end extends through the tube 198 with an O-ring 201 sealing the shaft with respect to the tube 198. A lever 202 is attached to the shaft 200 at the upper end thereof via washer 204 and nut 206, the lever being conventionally keyed to the shaft 200 and projecting radially of the shaft outwardly through the slot 78 in the casing 56 (see FIG. 2). At the lower end of the shaft 200 a locking lever 208 is keyed thereto and secured via washer 210 and nut 212. The lever 208 is angled relative to lever 202 and has a projection 214 at its free end. When the lever 202 is rotated from the solid line position of FIG. 2 to the dotted line position the projection 214 will be brought into engagement with the recess 196 in the adjusting nut 186 so as to prevent rotation of nut 186 while the tube 168 is rotated manually via the distal end of shaft 66. The relative rotation between tube 168 and nut 186 causes the nut to travel along the tube 168 thereby altering the gap between the nut and the upper bowl member and hence the degree of possible separation between the upper and lower bowl members. An adjustment wheel 203, may be provided above the motor 62 to effect the desired rotation of shaft 66 and tube 168. With the locking levers 202,208 in the solid line position of FIG. 2 the nut 186 rotates along with the tube 168.

The structure within the upper and lower bowl members 140,116 will now be described with reference to FIGS. 1 and 3 to 12.

Figure 3:
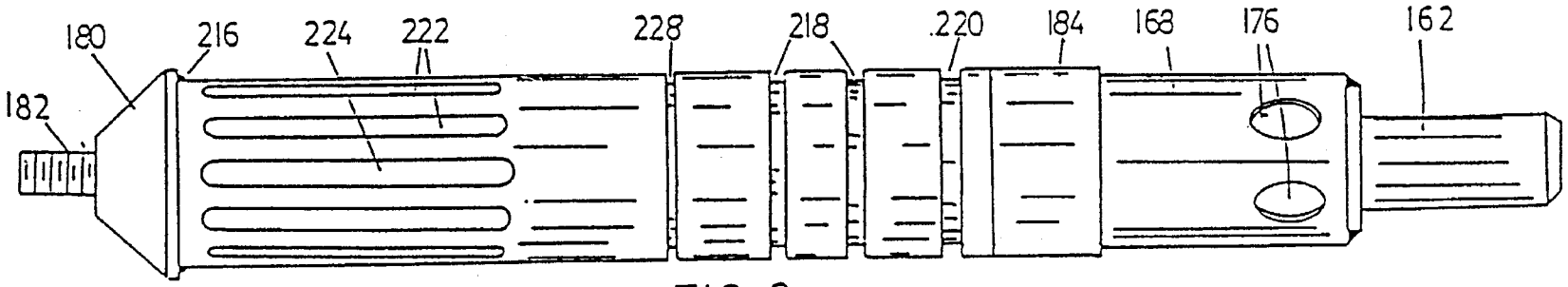
FIG. 3 shows the transfer tube of the centrifuge and FIG. 4 is a longitudinal section through the tube.
Figure 4:
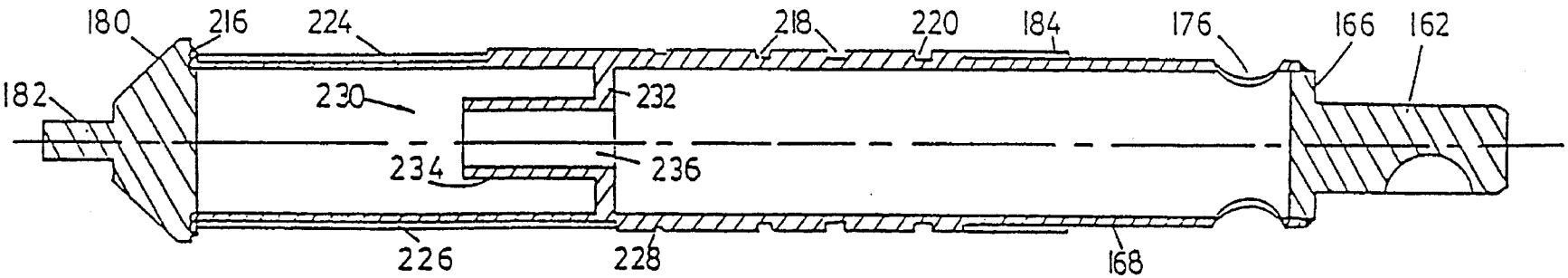

With particular reference first of all to FIGS. 3 and 4 further details of the transfer tube 168 will be described. It will be noted for example from FIG. 4 that the tube 168 is welded to the enlarged head 180 as at 216 so that the shaft 162, the head 180 and the transfer tube 168 will rotate together as the shaft 162 is rotated by the motor 62. Also shown in FIGS. 3 and 4 are the circumferential grooves 218,218,220 which receive the O-rings 170,170,194 respectively, the circumferentially spaced openings 176 and the external threads 184 to which the adjusting nut 186 is threaded.

At its lower end, closer to the head 180 the tube 168 is provided with a plurality of circumferentially spaced, axially extending, round ended slots 222, which slots are located circumferentially between a pair of diametrically opposed, axially extending keyways 224,226. As seen best in FIG. 4 the keyway 226 is longer than the keyway 224, extending away from head 180 almost to a narrow circumferential groove 228.

Internally, the tube 168 is provided with an integral sill 230 which includes an annular internal flange 232 and an axially downwardly extending cylindrical tube 234 defining an axial passage 236. The purpose of the sill 230 will become apparent hereinafter.

With reference again to FIG. 1 there will be seen an upper disc support member 238 having a through bore 240 receiving the tube 168 and an outer downwardly and inwardly sloping surface 242. An axially extending counterbore 244 receives the drive pin 152, which pin is also received in the counterbore 150 in the upper bowl member 140 such that the members 140,238 can rotate together. Furthermore, the member 238 has an axially extending keyway 248 in the bore 240 such that a key 250 is receivable therein as well as in the keyway 226, thereby keying the member 238 to the transfer tube 168.

Above the disc support member 238 a circlip or retainer ring 252, received in groove 228 of transfer tube 168 holds a wave spring 254 against the upper surface of the disc support member 238. The spring 254 applies a downwards bias against the disc support member 238.

Figure 5:
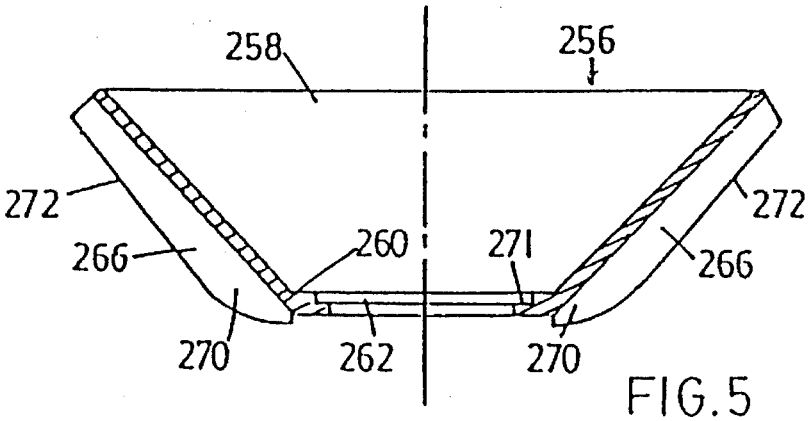
FIGS. 5 and 6 show a longitudinal section and a plan view of the lower disc support of the centrifuge.
Figure 6:
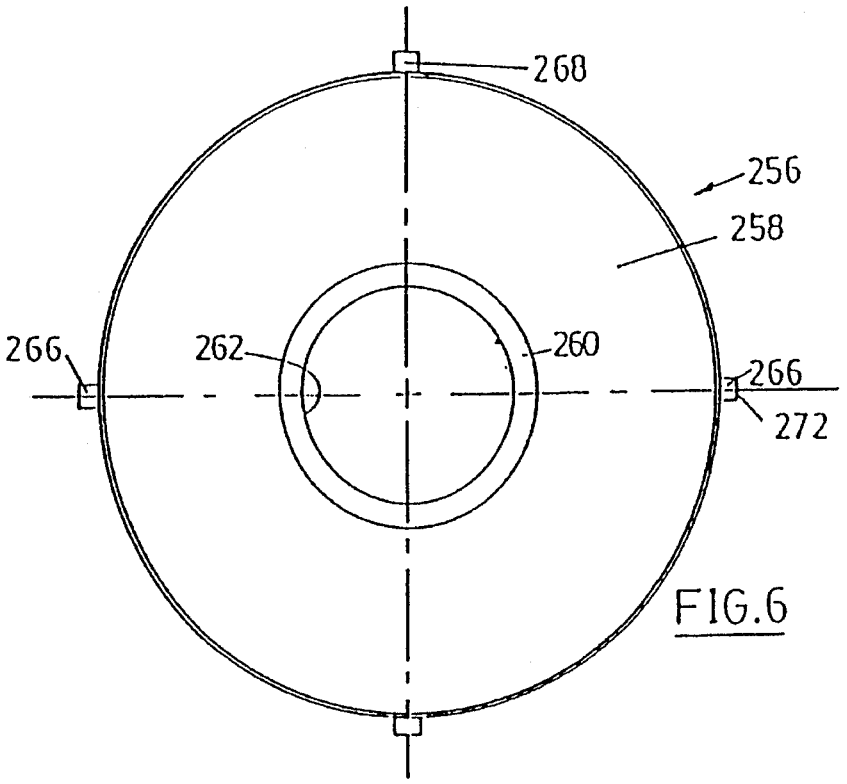

FIGS. 1, 5 and 6 illustrate a lower disc support member 256 which rests on the head 180. The member 256 includes upwardly and outwardly flaring frustoconical wall 258, which wall starts from a narrow lower annular flange 260. The flange has a central opening 262 through which the transfer tube 168 can pass.

Two pairs of diametrically opposed vanes 266,268 are provided on the outer surface of the wall 258 so as to extend the height thereof, with a portion 270 of each projecting below the bottom surface of flange 260. As seen in FIG. 1, there is a small clearance between the outer edge 272 of each vane 266,268 and the inner surface 276 of the lower bowl member 116.

With reference now to FIGS. 1 and 7 to 12, the remaining structural features of the invention of Ser. No. 579,008 will be described. In particular it will be seen from FIG. 1 that there is a plurality of separator discs 278,280,282 positioned between the lower and upper disc supports 256,238. There is a single lowermost disc 278, a plurality of intermediate discs 280 and a single uppermost disc 282. The discs 278,280,282 are shown more completely in FIGS. 7 to 12.

Figure 7:
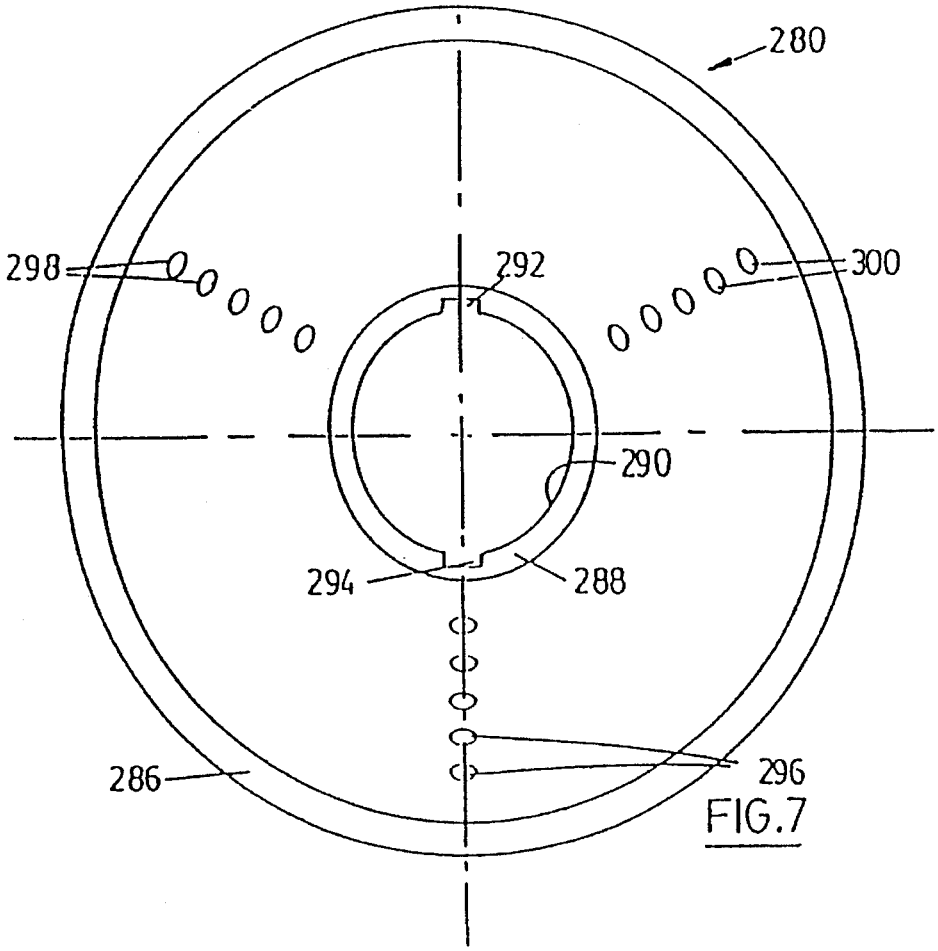
FIGS. 7 and 8 show a plan view and a longitudinal section of a disc member.
Figure 8:
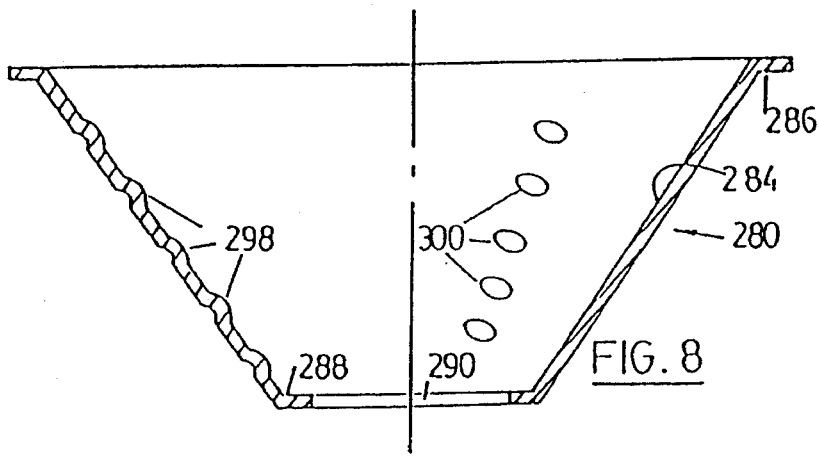

The separator discs 280 are best seen in FIGS. 7 and 8. Since the discs 280 are identical to each other, only one will be described, it being noted that the disc includes a frustoconical wall 284 with an outwardly projecting annular rim 286 at the upper, or largest diameter, end. At the lower, or small diameter end there is an inwardly directed annular flange 288 defining a central opening 290 and a pair of diametrically opposed slots or keyway 292,294. The opening 290 is of a size to receive the transfer tube 168 and the keyways are alignable with the keyways 224,226 in the tube 168.

The disc 280 may be formed from anodized aluminum and, radially aligned with one of the keyways 294, there is a linear series of generally hemispherical dimples 296 formed in the wall 284 so as to project into the interior of the disc. Two other radially aligned series of dimples 298,300 project into the interior of the disc along lines offset from the line of dimples 296 by about 120°.

Figure 10:
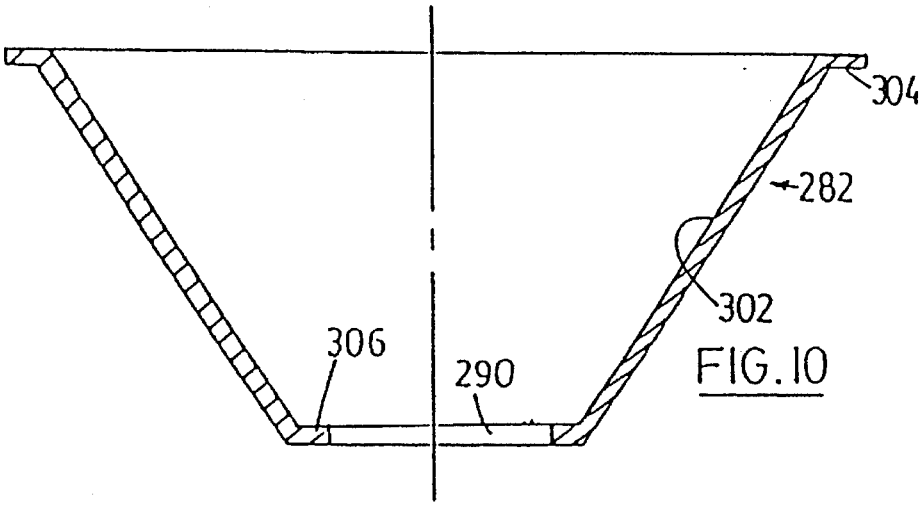
FIGS. 9 and 10 show a plan view and a longitudinal section of the upper disc member.
Figure 9:
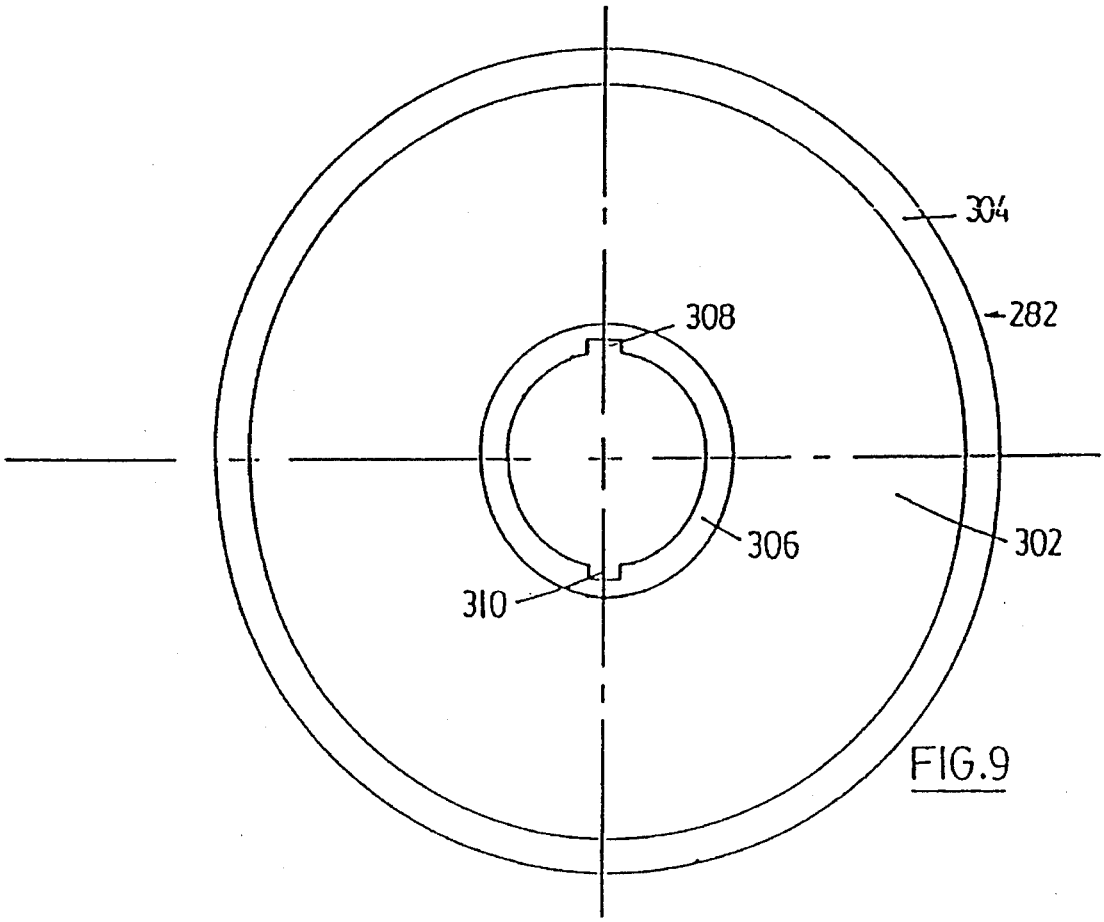

With reference to FIGS. 9 and 10, it will be seen that the upper disc 282 is essentially the same as the discs 280 except that it does not have any dimples therein. Thus, the frusto-conical wall 302 of the disc 282 is smooth. The disc 282 has a rim 304, flange 306 and keyway slots 308,310 which are analogous to the rim 286, flange 288 and keyway slots 292,294 of the disc 280.

Figure 11:
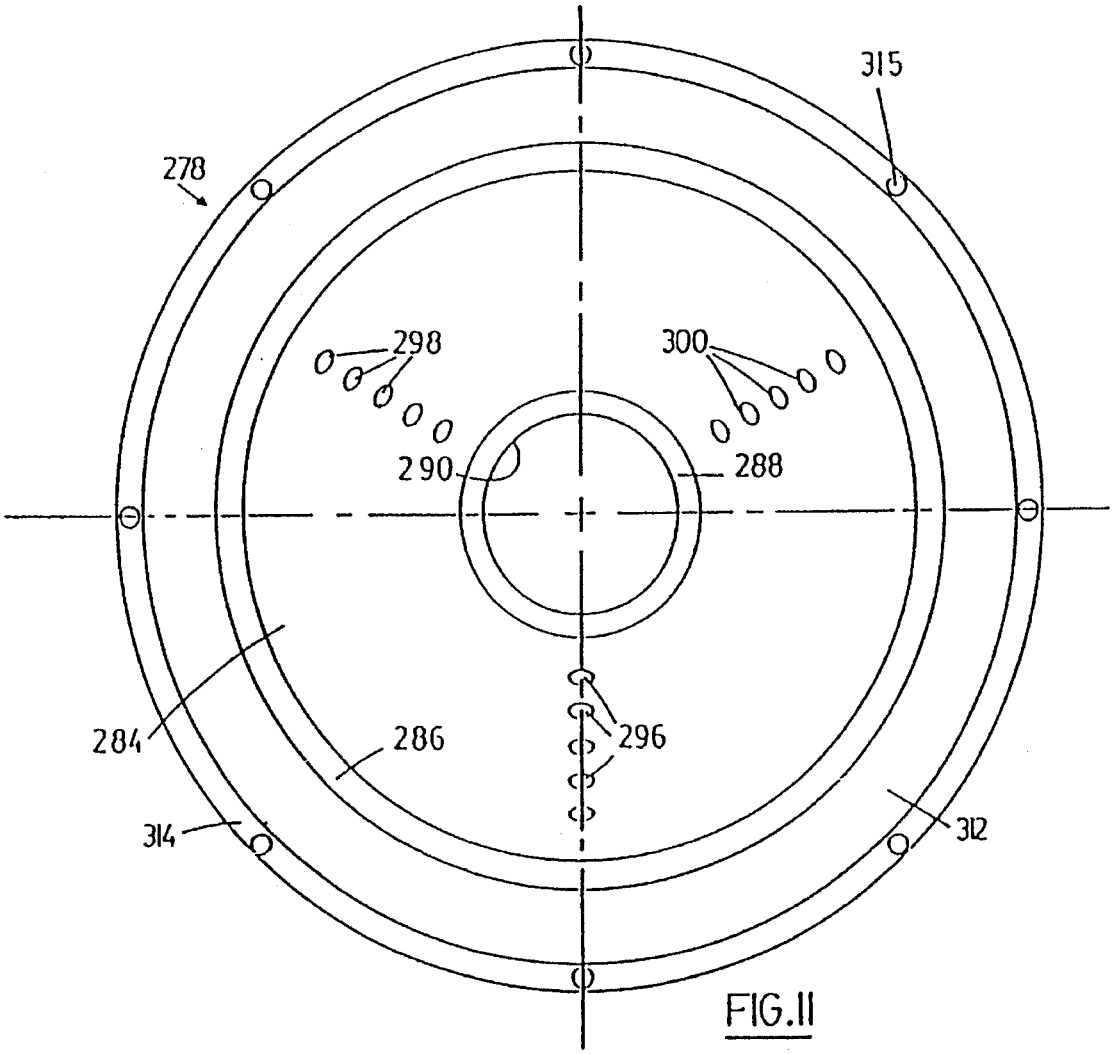
FIGS. 11 and 12 show a plan view and a longitudinal section of the lowermost disc member.
Figure 12:
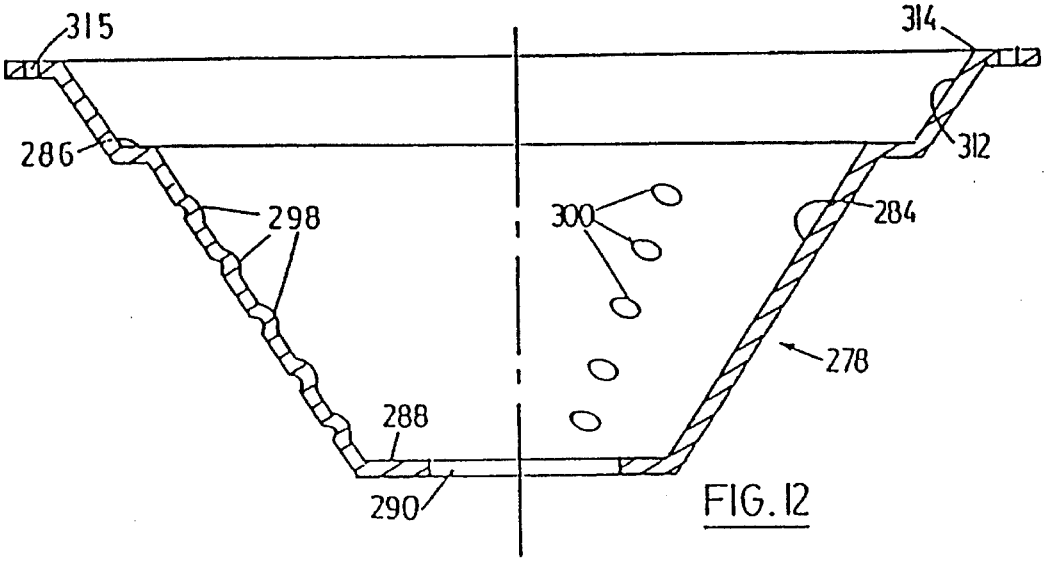

With reference to FIGS. 1, 11 and 12 it will be seen that the disc 278 is identical to the disc 280 except that it lacks keyways 292,294 and it includes an upwardly and outwardly flaring wall portion 312 which extends upwardly from the outer edge of rim 286 and which has an outer rim 314 at the upper edge thereof. A plurality of circumferentially spaced circular feed ports or holes 315 may be provided through or near the outer rim 314 of the lowermost disc 278.

When assembling discs to achieve the configuration of FIG. 1, one first of all slides the lower disc support member 256 down over the tube 168 with the tube 168 passing through the opening 262 and the flange 260 resting on the lower head 180 of the tube 168. If desired, an O-ring may be placed in a recess 271 in the upper portion of the disc support 256, on which the flange 288 will rest, (see FIG. 5) so as to prevent air from being drawn into the pump from the transfer tube. Alternatively, the lowermost disc 278 could be bonded to the disc support or it could even be moulded integrally with the disc support itself and sealed to the transfer tube 168. One then, inserts a key 316 in keyway 224 of transfer tube 168 and the key 250 in the keyway 226 of the transfer tube 168.

With the lower disc support member 256 in place, the lower disc 278 is placed over the tube 168 until its wall 284 rests on the inner wall 258 of the support member 256.

From FIG. 1, it is seen that the included cone angle of the support member 256 and of the disc 278 is greater than the included cone angle of the lower bowl member 116 so that the inner wall of the bowl member approaches the wall 284 of the disc 278 in the vicinity of the rim 286. The inner wall of the bowl member is circumferentially recessed as at 318 to accept the rim 286 in close juxtaposition thereto, the upper wall portion 312 of the disc member 278 being located within the recessed wall area 318.

Thereafter, one places on the tube 168 the plurality of discs 280 to achieve a build-up of vertically spaced apart discs 280 (due to the dimples 296,298,300) above the disc 278, all of the discs 278,280 being keyed to the transfer tube via keys 250,316. In order to effectively utilize the dimples 296,298,300 to space the walls 284 of the discs 278,280 apart, one should ensure that the keyway slot 294 of successive discs is only engaged with one of the keys 250,316 so that the dimples of each disc coincide with the dimples of the adjacent discs. This reduces the impact of the dimples on separation.

After the topmost disc 280 is assembled to the tube 168, the upper disc 282 is placed over the tube 168 and keyed thereto by engagement of the keyway slots 308,310 with the keys 250,316. The upper disc 282 rests on the dimples 296,298,300 of the uppermost disc 280. Then the upper disc support member 238 is assembled onto the tube 168 with the keyway slot 248 therein engaging the upper end of key 250. The wave spring 254 is placed on the tube 168 to rest on the upper surface of the upper disc support member and the circlip 252 is placed in the groove to clamp the members therebelow into a unitary rotatable assembly, one with the transfer tube 168.

Finally, a short length of shaft 320 may be threaded onto the threaded shank 182 of the head 180, the shaft 320 having a conical end 322 projecting into the innermost cylinder or tube 134. This shaft 320 promotes acceleration of the fluid and prevents cavitation.

OPERATION OF THE ESTABLISHED STRUCTURE

With the decanting centrifuge of the invention of Ser. No. 579,008 in position and locked to the neck 14 of a container 12, one, first of all, connects a source of pressurized gas, such as air, carbon dioxide, etcetera, (not shown) to the gas inlet port 82 in a conventional manner. Preferably the connection will be valved to control the pressure introduced into the centrifuge.

With the pressurized gas entering the centrifuge via port 82, the motor 62 is started and is controlled to rotate at a relatively low speed, preferably under 1000 r.p.m. The motor causes shaft 66 to rotate and that shaft in turn causes transfer bushing 160, transfer shaft 162 and transfer tube 168 to rotate. Furthermore, the upper bowl member 140 will rotate through its pinned connection to the upper disc support member 238 which is keyed to the transfer tube 168. Also, as the tube 168 rotates so will the discs 278,280,282 and the lower shaft 320.

In view of friction between the mating surfaces 146,148 of the upper and lower bowl members 140,116 initial rotation of the upper bowl member 140 will cause rotation of the lower bowl member 116 as well.

As the centrifuge operates, pressurized gas will pass via inlet port 82 into the interior between the bowl members 116,140 and the outer casing members 18,44. The pressurized gas will pass between the lower bearing support 84 and the mounting member 24, past the vanes 88 and along the annular passageway 96 defined between the outer and intermediate cylindrical members 42,92 to pressurize the container 12. Gas also flows between the upper rim of deflector plate 98 and the lower bowl member 116, through the bearing assemblies 104,110 and between the intermediate and inner cylindrical members 92,134 to help pressurize the container. Since the centrifuge seals the neck 14 of the container 12, the fluid therein is forced to rise along the inner cylindrical member 134 until it reaches the lower shaft 320 which, through its rotation, imparts additional rotary movement to the rising fluid. Since the lower bowl member 116 is rotating, the inner cylindrical member 134 will also be rotating and thus the rising fluid will be rotating at a progressively greater speed as it rises in the member 134.

When the rising fluid reaches the head 180, it will move upwardly and outwardly along the inner wall of the lower bowl member 116, past the vanes 266 and between the inner wall of the lower bowl member 116 and the lowermost disc 278. The fluid will eventually reach the open annular area between the bowl members 116,140 and the rims of the discs 280 and 282. As fluid continues to flow upwardly into the area 324, it will be forced to flow downwardly along the disc members 278,280 and the particulate matter within the fluid will be accumulating within the area 324 under centrifugal forces. Separated fluid, containing little or no particulate matter will flow inwardly and downwardly along and between the discs 278,280,282 and then pass through the slots 222 into the interior of the transfer tube 168.

Separated fluid within the transfer tube 168 will be forced upwardly through the cylindrical passage 236 of the sill 230. The sill creates a degree of back-pressure to ensure that separation of particulate matter will take place along all of the discs. Finally, the separated clean fluid will exit the openings 176 into the discharge chamber 76 and after sufficient fluid has accumulated therein, it will discharge through the outlet port 80 to be transferred to wherever the operator may desire.

As the fluid accumulates in the area 324 there will be sufficient upwards hydraulic pressure on the upper bowl member 140 to cause it to rise against the bias of wave spring 190 causing a small gap to appear between the mating surfaces 146,148. Fluid containing a large proportion of particulate matter will exit the area 324 centrifugally between the surfaces 146,148 and will fall downwardly along the essentially vertical inner wall of the outer housing member 20. This material is recycled to the container 12 under the influence of gravity. The separated material enters the container between the outer and intermediate cylindrical members 42 and 92.

Eventually, an equilibrium condition will be achieved with the fluid entering the centrifuge, separation occurring in the area 324, particulate matter exiting between the surfaces 146,148 as the bowl members rotate and supernatant (separated fluid) exiting via the discharge port 80.

The maximum gap between the surfaces 146,148 is adjustable by way of the adjusting nut 186 which defines a stop against which the upper bowl member 140 will abut when at its maximum open position. When it is necessary to alter the maximum opening between the surfaces 146,148, the operator will stop the centrifuge and rotate lever arm 202 to bring projection 214 into contact with the adjusting nut 186. While applying a slight pressure to the lever arm the operator manually rotates the motor shaft 66 via adjustment wheel 203 until the projection locks in notch 196. The adjustment nut is now locked. By manually rotating the adjustment wheel 203, the gap between the bowl members may be opened or closed. To run the centrifuge, the lever arm 202 is swung to the solid line position of FIG. 2 and locked in this position by a recess in the housing wall 78. If the wheel 203 has a rim mark thereon and if the top of the motor is provided with degree markings (not shown), it is possible to gauge the extent of the gap.

The deflector 98 plays an important role in the invention of Ser. No. 579,008 in that it helps to separate the gas flow from the recycle flow, thereby reducing foaming of the fluid. It also prevents the recycle fluid from flooding the bearings 104,110 and it minimizes fluid drag on the rotating cylinder member 134.

During start-up, there is some gas leakage between the bowl members because the seal therebetween will probably not be perfect. Such flow or leakage is negligible compared to the unimpeded gas flow directly into the container. This strong disparity in gas flows allows the centrifuge to be primed by gas pressure; once primed, it is not essential to maintain gas pressure other than to drive the light phase discharge through outlet 80. However, one would probably maintain gas pressure within the centrifuge to reduce fluid drag and to partially counterbalance hydraulic pressure in the bowl, thereby reducing load on the bearings.

If, as suggested previously, one or both of the cylinder members 42,92 terminates just inside the container, it is likely that foaming of the fluid within the container by the gas could be reduced. If the intermediate cylinder 92 and the inner cylinder 134 are of approximately equal length, extending towards the bottom of the container, it would be desirable to include a fluted steady bearing or a spider set (not shown) between the members just above the flange 130 to maintain the desired annular separation between the members during operation.

The centrifuge of the prior invention is designed to operate at a relatively low speed, less than 1000 r.p.m., and this enables the cost of materials to be less than for high speed centrifuges. The bowl member, the housing and perhaps even the discs may be plastic (e.g. polycarbonate) since the stresses on the components will be small. Furthermore, low speeds permit the maintenance of constant, unrestricted recycle. By being able to utilize continuous recycle, there will be little or no cell compaction in the area 324 and the centrifugal separation process is much gentler on living material than high speed centrifuges.

By combining the centrifuge 10 with the container 12 it is possible to continuously remove the supernatant and to replace the feedstock without disturbing the culture, a particular advantage for the microbiologist who is working with a yeast culture.

BEST MODE OF CARRYING OUT THE INVENTION

Figure 13:
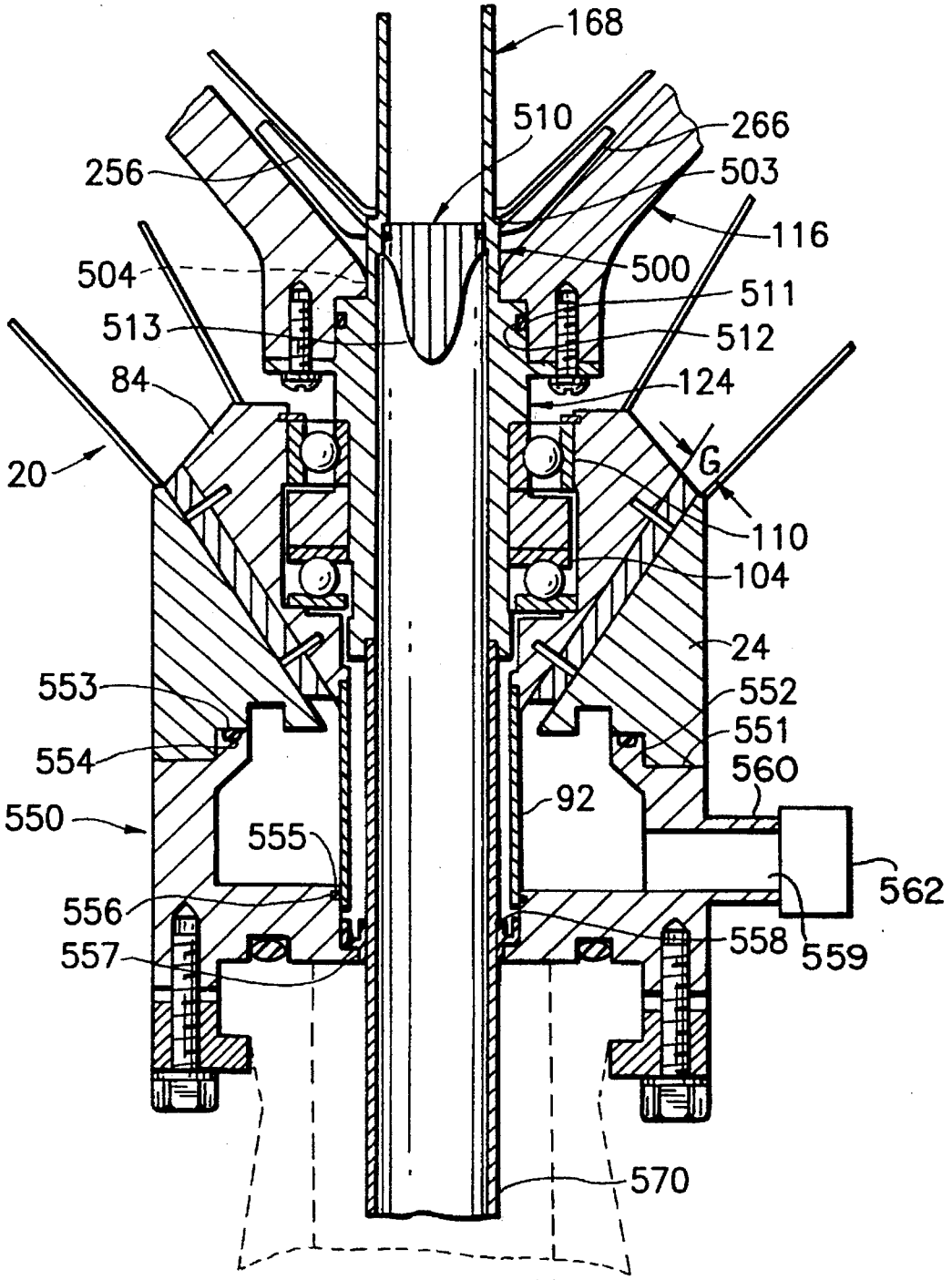
FIG. 13 shows a partial vertical cross-section through a portion of a decanting centrifuge incorporating certain improvements therein.
Figure 14:
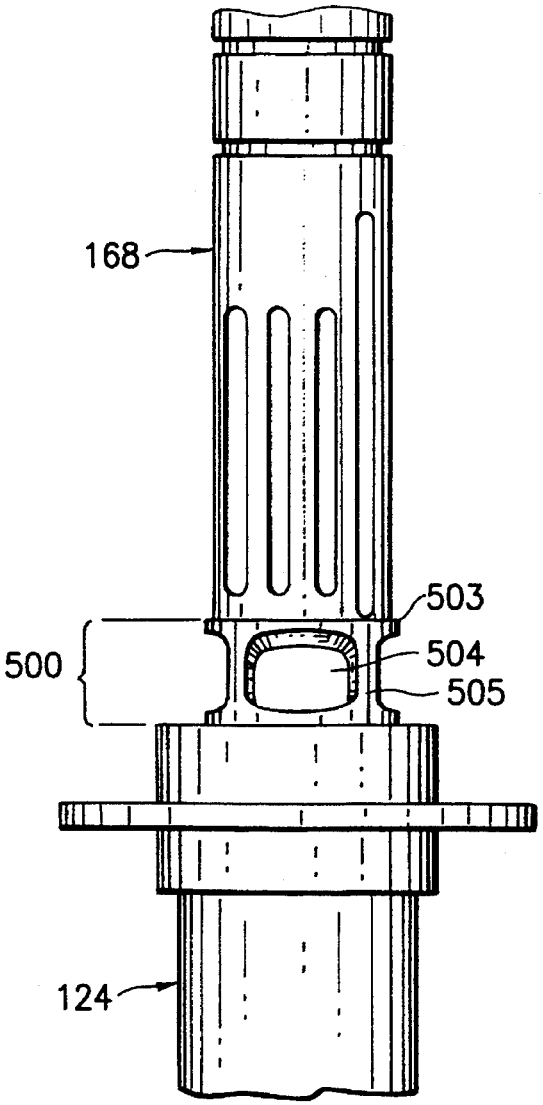
FIG. 14 shows a partial side view of the new transfer tube of the present invention.
Figure 15:
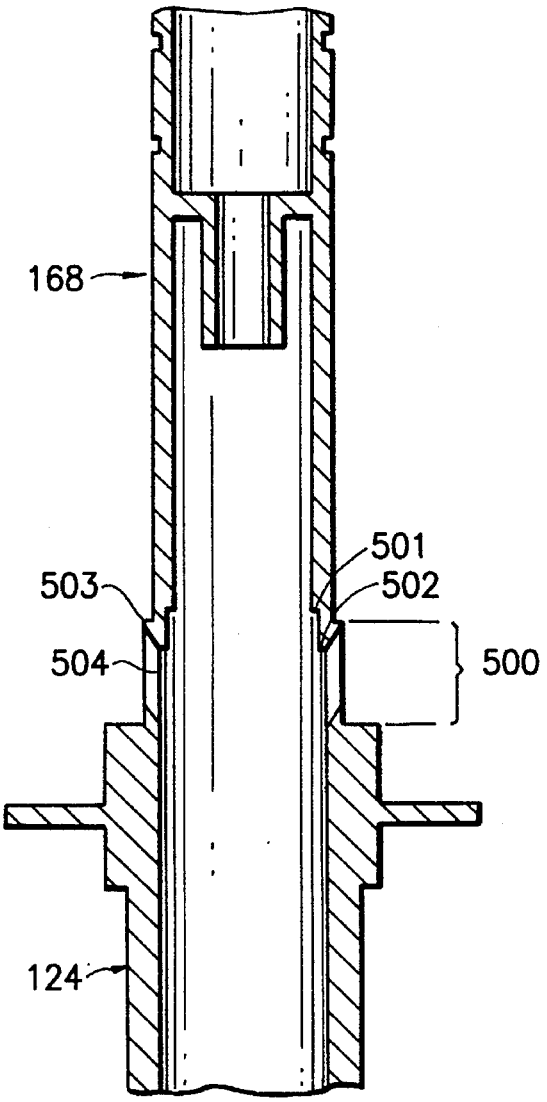
FIG. 15 shows a longitudinal cross-section of the transfer tube of FIG. 14.

FIGS. 13, 14 and 15 illustrate a revised centrifuge configuration in which the transfer tube 168 and bearing housing 124 of FIG. 1 are rigidly and integrally interconnected by a cylindrical connecting portion 500 such that the upper and lower bowl assemblies are restricted to rotation in unison and are mechanically restricted to a common axis of rotation. The inner diameter of the connecting portion 500 is greater than that of the transfer tube 168 such that the point of transition from the former to the latter is represented by a first shoulder 501. A second shoulder 502 defining a further increase in inside diameter of the connecting portion 500 is located a short distance below the first shoulder 501. Beyond the second shoulder 502 the inner wall of the connecting portion 500 is continuous with the inner wall of the bearing housing 124.

A removable partition member 510 located immediately below the shoulder 501 and above the shoulder 502 within the connecting portion 500 separates the bore of the connecting portion 500 from the bore of the transfer tube 168. The top surface of the partition member 510 forms the lower end wall of the transfer tube 168. An O-ring 511 is set in a groove 512 in the cylindrical outer wall of the partition member 510 to secure the partition member against excessive pressure differentials between the upper and lower surfaces and to prevent gas and fluid leakage. The lower end wall of the partition member 510 has a radially symmetrical generally curvingly frustoconical projection 513 analogous in function to the shaft 320 of FIG. 1.

The outer diameter of the connecting portion 500 is equal to the greatest diameter of the enlarged head 180 of FIG. 1 so as to form a shoulder 503 to support the lower dish support member 256. An abrupt increase in outside diameter defines the lower terminus of the connecting portion 500 and the upper terminus of the bearing housing 124. Beyond the said terminus the bearing housing 124 and its relationship to the lower bowl 116 and bearing assemblies 110 and 104 of FIG. 1 is defined as in FIG. 1.

The present embodiment calls for the continued use of thrust bearings to carry the weight of the rotating members and their contents. Thrust bearings could also be used where the drive means is isolated from the drive shaft 162 of FIG. 1 as where a magnetic coupling device is employed or where the drive force is applied instead to the lower end of the centrifuge. Where the weight of the rotor is carried elsewhere, as by the drive means, radial bearing means may still be required to prevent excessive vibration.

A uniform circlet of circumferentially spaced upwardly oriented, channels or apertures 504 in the connecting portion 500 between the second shoulder 502 and the bearing housing 124 provides for passage of feedstock into the lower bowl. Each port 504 is separated from adjacent ports by solid wall portions 505 which correspond generally in radial position to the vanes 266,268 on the outer surface of the lower disc support member 256 of FIGS. 5 and 6.

The foregoing modification by itself is operable with the basic invention of FIG. 1. A further modification to the embodiment of FIG. 1 also illustrated in FIG. 13, may be used with the foregoing modification or with the basic invention of FIG. 1. The said modification consists of recycle discharge means in the form of a detachable annular reservoir member 550 for reception of recycle fluid or particle concentrate from the lower bowl housing 20 of FIG. 1 through the gap G between the bearing support member 84 and the mounting member 24 of FIG. 1. The upper rim 551 of the reservoir member 550 is so configured as to mate with the base surface of the mounting member 24. A cylindrical extension 552 of the rim 551 approximates the inner horizontal surface of the base of the mounting member 24 and carries an O-ring 553 set in an O-ring groove 554 for sealing engagement therebetween. The outer and inner side walls of the reservoir 550 are cylindrical and encompass between them a plurality of circumferentially spaced apart bores and counterbores (not shown) for reception of threaded bolts which secure the member 550 to the housing member 24 by way of the threaded bores 30 of FIG. 1. The inner side wall and floor of the reservoir and outer wall of the intermediate cylindrical member 92 of FIG. 1, appropriately shortened, define the inner cavity or recycle chamber of the reservoir. The intermediate cylindrical member 92 extends slightly beyond the floor of the reservoir and sealingly engages an O-ring 555 set in a groove 556 in the innermost cylindrical wall of the reservoir member 550. Below the lower end of the intermediate cylindrical member 92 a pair of inwardly directed annular flanges on the innermost cylindrical wall of the reservoir member 550 define the upper and lower boundaries of a second groove or recess 557 for reception of seal 558 for sealingly engaging the inner cylindrical member 570, analogous to the inner cylindrical member 134 of FIG. 1, thereby preventing leakage of gas from the housing by way of the bearing assemblies. Lubricating fluid may be introduced into the annular cavity between the inner cylindrical member 570 and intermediate cylindrical member 92 during assembly to lubricate the seal 558 and, if appropriate, the bearing surfaces as well.

A discharge port 559 is located in the lower side wall of the reservoir member 550 and leads into a cylindrical extension 560 of the outer side wall of the reservoir member 550 for attachment of fluid pressure relief valve means 562 (see below) for maintenance of back pressure within the centrifuge housing. Conduit means 562 (not shown) carry the recycle concentrate from the valve means back to the container for further treatment, or to any other appropriate location as desired.

The base of the reservoir member 550 corresponds to the base of the mounting member 24 with an appropriate O-ring groove and threaded bores for sealing and coupling to the container in the manner of the mounting member 24 in FIG. 1 or for attachment to a stand.

The present embodiment depicts the inner cylindrical member 570 continuing toward the bottom of the container in the manner of FIG. 1. However, since the inner cylindrical member 570 is directly linked to the drive means it is now practical to couple the inner cylindrical member 570 to stationary conduit means (not shown) employing conventional sealing means and means to secure such conduit means. The conduit means may represent a linear continuation of the inner cylindrical member 570 as where the container is too deep to allow the cylindrical member to continue uninterrupted or it may represent a non-linear continuation where the centrifuge is not mounted directly onto the container.

Depending on the operating pressure of the housing it may be necessary to strengthen the housing members beyond the minimal capabilities required in the established structure and employ a higher pressure seal than the seal 172 shown in FIG. 1.

Although the present invention may be retrofitted to the invention defined in Canadian Patent Application Ser. No. 579,008 it is considered apparent from the present specification that a centrifuge designed specifically for high pressure operation or operation remote from the container could be simplified in some respects without departing from the spirit of the present invention. For example, the bearing support member 84 could be continuous with the inner surface 20 of the lower housing thus eliminating the gap G and allowing the recycle fluid to exit by way of an outflow port set in the lower housing wall with the added advantage of imparting further rigidity to the bearing support member 84 as may be preferred where thrust bearing means supporting the rotating members are located elsewhere.

Conventional sealing means could then be inserted between the intermediate cylindrical member 92 and the cylindrical member 570 to prevent discharge front the housing by way of the bearing assembly. These same modifications could also be applied to the original embodiment of FIG. 1 but may also call for means applying the drive force directly to the lower bowl assembly.

Finally, it should be appreciated that in the present and original embodiments it would be possible to hold the upper bowl member stationary on the transfer tube and to utilize appropriate spring biasing means between the bearing support means and the lower bowl member so that the lower bowl member can move relative to the upper bowl member during operation. 0f course, both bowl members could also be arranged in such a manner that both can move vertically relative to each other.

OPERATION OF THE PRESENT INVENTION

Operation of the present invention is largely the same as in the case of the established structure described herein except that with the seal 555 in place gas can only enter the container by way of the recycle return conduit. With reference to FIGS. 1 and 13 the adjustment nut is preset to provide the desired bowl gap at the operating housing pressure. Gas pressure to the housing is controlled by an automatic gas regulator 564 set to allow gas into the housing by way of inlet port 82 when the housing pressure falls below a predetermined level. Recycle fluid or particle concentrate discharge from the housing is controlled by the fluid pressure relief valve 562 set to open automatically whenever housing pressure exceeds the operating, pressure of the gas regulator. With the housing pressurized to the desired operating level and the gas inlet valve open the centrifuge is charged with feedstock from the container by pressurizing the container directly for example, via an inlet port 567. The centrifuge is then run up to operating speed and the container is further pressurized to force supernatant from the disc stack into the transfer tube 168 and out of the centrifuge by way of discharge ports 80 of FIG. 1. At operating speed the selected housing pressure and preset load on spring 190 may not be sufficient to prevent the upper bowl from separating from the lower bowl under the influence of hydraulic pressure within. Therefore, as in the previous embodiment, the upper bowl member 140 of FIG. 1 will rise along the transfer tube allowing recycle fluid to exit by way of the established gap between the rims of the upper and lower bowl members. As recycle fluid enters the bowl housing it will cause housing pressure to increase beyond the common setting of the gas regulator and fluid pressure relief valve 562 causing the latter to open and discharge the recycle fluid back to the container or elsewhere. Gas from the housing which becomes entrained in the recycle flow can be vented from the container by way of a gas pressure relief valve 566 set at the operating pressure of the container. Under some circumstances gas entrainment in the recycle fluid may lead to excessive displacement of gas within the housing by recycle fluid. This situation may be avoided by setting the operating pressure of the gas flow regulator 564 higher than the operating pressure of the fluid pressure relief valve 562 to assure adequate replacement of the gas lost through entrainment.

There are circumstances where it may be preferable or necessary to employ negative pressure at the discharge port 80 to draw supernatant from the centrifuge instead of applying positive pressure at the innermost cylinder. This mode of operation would reduce the risk of discharge of culture material into the atmosphere as to prevent contamination of the local environment or avoid risk to human health. It would also permit the centrifuge to draw suspension from an open container, as in sewage treatment or mass culture facilities. Both the former and present embodiment of the centrifuge may be operated in this mode following a minor change of seal 178 to prevent gas entering the discharge chamber 76 from above. Thus it is seen that the invention may be generally considered as being operable with a pressure differential created between the housing or discharge chamber and the fluid container.

I claim:

1. A decanting centrifuge assembly for separating particulate matter from a fluid held within a container comprising:

a housing;

lower bearing support means within said housing;

a lower bowl assembly including an upwardly and outwardly flaring lower bowl member affixed to lower bearing means, a cylindrical member extending downwardly therefrom, and bearing means between said lower bearing means and said lower bearing support means for rotatably and bearingly supporting said lower bowl assembly within said housing;

cylindrical transfer tube means extending downwardly into said housing to within said lower bowl member;

an assembly of upwardly and outwardly flaring vertically spaced apart frustoconical discs attached to the lower end of said transfer tube means in an upper discharge chamber of said housing and lower inlet port means adjacent said discs;

apertured connection means integrally connecting said transfer tube means to said lower bearing means;

partition means blocking said transfer tube means between said inlet port means and said connection means;

recycle fluid discharge means in said housing;

an upper bowl member having an outer rim engageable with an outer rim of said lower bowl member and defining a centrifuge chamber with said lower bowl member, said centrifuge chamber enclosing said discs;

means biasing said upper bowl member towards said lower bowl member; and means for creating a pressure differential between said container and said discharge chamber, said pressure differential serving to transfer fluid from said container into said centrifuge assembly via said cylindrical member, said connection means including an annular portion having a plurality of circumferential spaced aperture extending therethrough and leading from said cylindrical member into said centrifuge chamber.

2. The decanting centrifuge assembly of claim 1 wherein said bearing means includes a lower thrust bearing assembly, an upper radial bearing assembly and annular space means separating said upper and lower bearing assemblies.

3. The decanting centrifuge assembly of claim 1 wherein said partition means comprises a cylindrical member having a circumferential groove at one end receiving an annular seal member engagable with said connection means adjacent said internal shoulder and generally curvingly frustoconical portion projecting towards said cylindrical member.

4. A centrifuge assembly for separating particulate matter from a fluid/particle mixture held within a container, the container being in fluid communication with the centrifuge assembly, the centrifuge assembly comprising:

a housing;

a rotating chamber made in at least two parts having a substantially annular cross-section in the plane of rotation thereof;

means for gas pressurizing said housing, said gas pressure within said housing biasing said two parts together;

means for transferring said fluid/particle mixture from said container to said rotating chamber, thereby charging said chamber with said fluid/particle mixture;

transfer means for discharging a reduced concentration fluid/particle mixture from said rotating chamber and said housing during rotation of said rotating chamber; and wherein at least partial separation of fluid and particles takes place in said rotating chamber, thereby reducing the particle concentration in said fluid/particle mixture and forming said reduced concentration fluid/particle mixture leaving therefrom via said transfer means, wherein said means for gas pressuring said housing is operable without said rotating chamber being fully charged with said fluid/particles mixture, for pressurizing said housing to an extent that is sufficient to substantially achieve counterbalance of hydrostatic pressure within said rotating chamber, and wherein said gas pressure within said housing is sufficient to prevent said two parts of said rotating chamber from separating unless the hydrostatic pressure within said rotating chamber exceeds a predetermined value, whereby said two parts of said rotating chamber separate to enable a high particle concentration fluid/particle mixture to escape from said rotating chamber.

5. A decanting centrifuge assembly for separating particulate matter from a fluid/particle mixture head within a container, said centrifuge comprising:

a housing;

an upper discharge chamber within said housing;

lower bearing support means within said housing;

a lower bowl assembly within said housing, said lower bowl assembly having lower bearing means, and bearing means disposed between said lower bearing means and said lower bearing support means for rotatably and bearingly supporting said lower bowl assembly within said housing, said lower bowl assembly further having a lower bowl member which extends generally upwardly from said lower bearing means and outwardly from the center of said lower bowl assembly;

a cylindrical member extending downwardly from said lower bowl assembly and fluidly communicating with said container;

cylindrical transfer tube means extending downwardly from said upper discharge chamber to within said lower bowl member;

an assembly of upwardly and outwardly flaring vertically spaced apart frustoconical discs attached to a lower end of said transfer tube means, said transfer tube means having upper discharge port means in said upper discharge chamber and lower inlet port means adjacent said discs, a reduced particle concentration fluid/particle mixture entering said lower inlet port means, passing through said transfer tube means, and exiting said transfer tube means via said upper discharge port means into said discharge chamber;

an upper bowl member having a downwardly and outwardly flaring rim generally corresponding to and sealingly engageable with a downwardly and outwardly flaring rim of said lower bowl member and defining a rotatable centrifuge chamber with said lower bowl member, said centrifuge chamber enclosing said discs;

means for gas pressurizing said housing, said gas pressure within said housing biasing said upper bowl member towards said lower bowl member;

wherein at least partial separation of fluid and particles takes place in said centrifuge chamber, thereby reducing the particle concentration in said fluid/particle mixture and forming said reduced concentration fluid/particle mixture leaving therefrom via said transfer tube means;

said gas pressure within said housing providing counterbalance of hydrostatic pressure of said fluid/particle mixture within said centrifuge chamber, and allowing a high particle concentration fluid/particle mixture to escape from said centrifuge chamber when the pressure within said centrifuge chamber exceeds a predetermined value;

means for creating a pressure differential between said container and said discharge, said pressure differential serving to transfer said fluid/particle mixture from said container into said centrifuge assembly via said cylindrical member, thereby charging said centrifuge chamber with said fluid/particle mixture; and wherein said means for gas pressurizing said housing is operable without said centrifuge chamber being fully charged with said fluid/particle mixture.

6. The decanting centrifuge assembly as claim in claim 5 wherein said lower bowl assembly includes a conical outer annular surface corresponding to a conical annular surface of said upper bowl member.

7. The decanting centrifuge assembly as claimed in claim 5 further comprising:

means for admitting gas under pressure into said housing via a gas inlet port in said housing;

means for preventing leakage of gas from said housing; and relief valve means connected to a recycle discharge port for controlling the pressure within said housing such that a positive pressure differential can be maintained between said housing and said upper and lower bowl members.

8. The decanting centrifuge assembly as claimed in claim 7 wherein said lower bowl assembly includes a conical outer annular surface corresponding to a conical annular surface of said upper bowl member.

9. The decanting centrifuge assembly of claim 5, wherein said housing comprises an upper inversely frustoconical section closely adjacent said upper bowl member, an upper cylindrical portion above said upper section and containing said discharge chamber with an outlet port leading therefrom, and a lower section having said lower bearing support means mounted therein for rotatably and bearingly supporting said lower bowl assembly within said lower section via said lower bearing means and said bearing means, said lower section having downwardly extending sides and a lower portion connected to mounting means for mounting said centrifuge assembly to said container.

10. The decanting centrifuge assembly of claim 9 wherein said cylindrical member is rigidly affixed to said lower bearing means.

11. The decanting centrifuge assembly of claim 9, wherein said housing further includes recycle fluid discharge means having an annular member sealingly connected to said mounting means therebelow and including a dynamic seal member engaging said cylindrical member as it passes through said annular member, an intermediate cylindrical member connected to said lower bearing support means and to said annular member and surrounding said cylindrical member, and a recycle discharge port located in a wall of said annular member; and wherein an annular recycle discharge chamber is located between said wall of said annular member and said intermediate cylindrical member for receiving a recycle fluid from said housing, said recycle fluid being said high particle concentration fluid/particle mixture.

12. The decanting centrifuge assembly of claim 11 comprising conduit means connected between said recycle discharge chamber and said container for transferring said recycle fluid from said recycle discharge chamber to said container.

13. The decanting centrifuge assembly of claim 9 wherein said frustoconical discs include a lower disc member, a plurality of intermediate disc members and an upper disc member, each of said disc members having a lower annular flange for reception of said transfer tube means therein, a frustoconical wall portion extending upwardly from said flange and a peripheral outwardly extending flange at the upper rim thereof.

14. The decanting centrifuge assembly of claim 13 wherein said transfer tube means includes a pair of diametrically opposed keyways extending along a lower portion thereof and wherein each of said intermediate and upper disc members includes a pair of diametrically opposed key slots in the annular flange for mating engagement with keys contained in said keyways.

15. The decanting centrifuge assembly of claim 13 including a frustoconical lower disc support member below said lower disc member and sealably engageable with said transfer tube means, said lower disc support member including a plurality of radially extending vanes circumferentially spaced apart and extending downwardly to adjacent an inner wall of said lower bowl member.

16. The decanting centrifuge assembly of claim 13 wherein said lower bowl member includes a peripherally recessed area adjacent said downwardly and outwardly flaring rim thereof and wherein said lower disc member includes an upper wall portion within said recessed area and extending upwardly and outwardly from said peripheral outwardly extending flange thereof, there being a second peripheral flange extending outwardly from said upper wall portion.

17. The decanting centrifuge assembly of claim 13 wherein said transfer tube means includes sill means therein, said sill means including an inwardly extending annular flange and a cylindrical section extending from said inwardly extending annular flange towards a lower end of said transfer tube means.

18. The decanting centrifuge assembly of claim 13 including an upper disc support member below said upper bowl member, resting on said upper disc member and keyed to said transfer tube means and connected to said upper bowl member.

19. The decanting centrifuge assembly of claim 13 wherein each of said intermediate disc members and said lower disc member includes a plurality of upwardly directed generally spherical dimples in said frustoconical wall portion thereof, said dimples being arranged in circumferentially spaced radially directed lines along the radial length of said frustoconical wall portion.

20. The decanting centrifuge assembly of claim 19 wherein said upper bowl member includes an annular flat central section and a peripheral outer portion of inverted-V shape, the outer portion including a downwardly and outwardly flaring annular surface which is sealing engageable with an upper annular surface of said lower bowl member.

21. The decanting centrifuge assembly of claim 20 including an adjusting nut threaded to said transfer tube means above said annular flat central section of said upper bowl member, an annular spring means positioned between said nut and said annular flat central section of said upper bowl member biasing said upper bowl member towards said lower bowl member, and means for setting said adjusting nut at a desired position.

* * * * *

UNITED STATES PATENT AND TRADEMARK OFFICE

CERTIFICATE OF CORRECTION

PATENT NO. : 5,487,720

DATED : January 30, 1996

INVENTOR(S) : PACE

It is certified that error appears in the above-indentified patent and that said Letters Patent is hereby corrected as shown below:

On the title page:

Item: [57], line 11 "a discharge chamber," should read --a discharge chamber.--

Column 16, line 1 (claim 12) "assembly of claim 11 comprising" should read --assembly of claim 11 further comprising--

Signed and Sealed this

Eighteenth Day of June, 1996

*Attest:*

*Attesting Officer*

BRUCE LEHMAN

*Commissioner of Patents and Trademarks*